US005562499A

United States Patent [19]

Minich

[11] Patent Number: 5,562,499

[45] Date of Patent: Oct. 8, 1996

[54] MULTIPOSITION ELECTRICAL CONNECTOR FILTER ADAPTER

[75] Inventor: Steven E. Minich, Carlisle, Pa.

[73] Assignees: Stanley E. Gately; Catherine G. Gately, both of Russellville, Ark.

[21] Appl. No.: 380,485

[22] Filed: Jan. 30, 1995

[51] Int. Cl.[6] ..... H01R 13/66

[52] U.S. Cl. ..... 439/620

[58] Field of Search ..... 439/620; 333/181–185

[56] References Cited

U.S. PATENT DOCUMENTS

| | | | |
|---|---|---|---|
| 3,760,335 | 9/1973 | Roberts | 439/398 |
| 4,126,840 | 11/1978 | Selvin | 333/79 |
| 4,212,510 | 7/1980 | Ritchie et al. | 339/147 R |
| 4,215,326 | 7/1980 | Hollyday | 333/182 |
| 4,398,780 | 8/1983 | Novothy et al. . | |
| 4,660,907 | 4/1987 | Belter | 339/14 R |
| 4,726,790 | 2/1988 | Hadjis | 439/620 |
| 4,772,224 | 9/1988 | Talend | 439/620 |
| 4,862,311 | 8/1989 | Rust et al. | 361/91 |
| 4,930,200 | 6/1990 | Brush, Jr. et al. | 29/25.42 |
| 5,057,041 | 10/1991 | Yu et al. | 439/620 |
| 5,141,455 | 8/1992 | Ponn | 439/620 |
| 5,152,699 | 10/1992 | Pfeifer | 439/620 |
| 5,236,376 | 8/1993 | Cohen | 439/620 |
| 5,246,389 | 9/1993 | Briones | 439/620 |
| 5,269,704 | 12/1993 | Ohashi | 439/620 |
| 5,344,342 | 9/1994 | Briones | 439/620 |
| 5,352,995 | 10/1994 | Mouissie | 333/181 |

OTHER PUBLICATIONS

AMP Instruction Sheet, IS 3171, 1987.

*Primary Examiner*—Gary F. Paumen

[57] ABSTRACT

A filter adapter (2) uses back to back multiposition plug and receptacle or male and female electrical connectors (4, 6) each of which has terminals (10, 12) mounted in an insulative housing (12, 14). Filter components, such as surface mount capacitors (18), are positioned between terminals (10, 12) and a ground bus (20) located between the two back to back connectors (4, 6). Each terminal has a resilient plate (30) located at its end, and the plates resiliently engage the capacitors to urge them against the ground bus. Each terminal includes insulation displacement slots (32, 34), and wire segments are inserted into these slots to connect corresponding terminals and to secure the capacitors in place. One of these slots (32) is located in the resilient plate (30), and insertion of the wire shortens the resilient beam length of the portion of the plate engaging the capacitor to increase the force on the capacitor.

20 Claims, 6 Drawing Sheets

Fig. 3
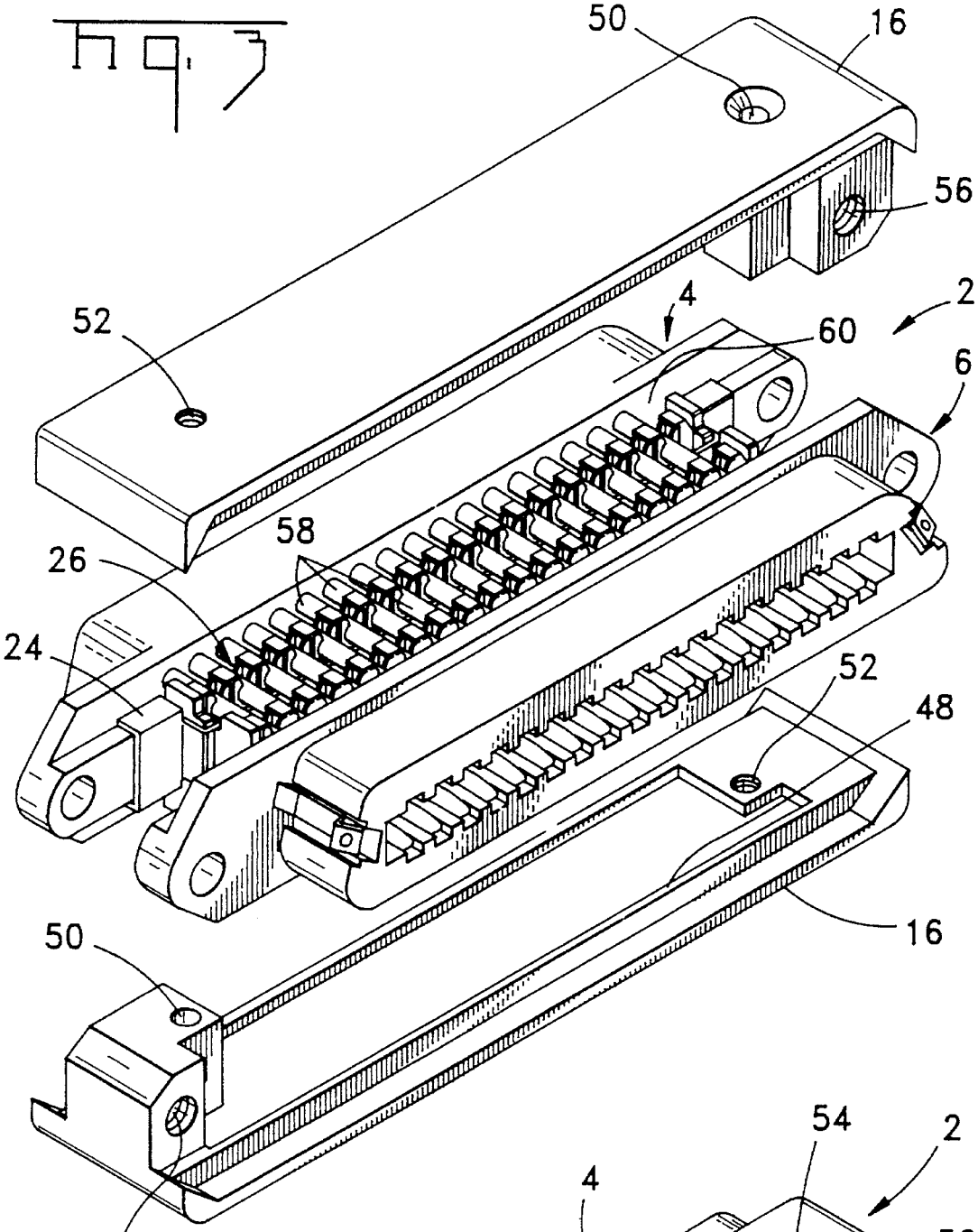
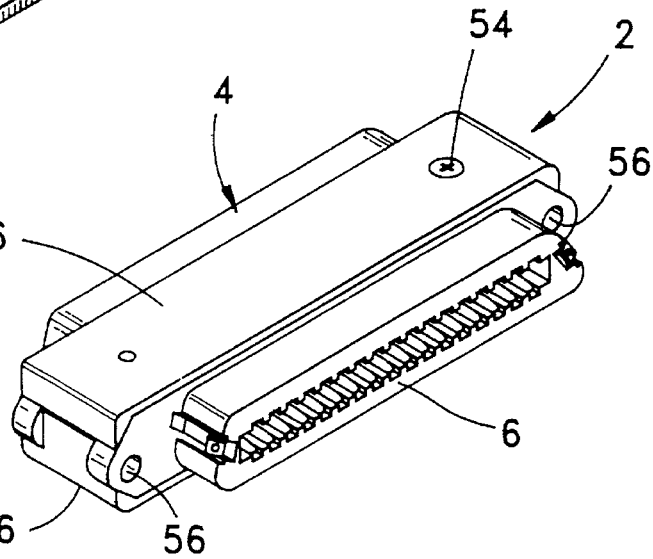
Fig. 4

MULTIPOSITION ELECTRICAL CONNECTOR FILTER ADAPTER

FIELD OF THE INVENTION

This invention is related to filtered electrical connectors of the type in which a filter component is added to the electrical connector for filtering noise. More particularly this invention is related to filtered electrical connector adapters in which two connectors are mated back to back with capacitive filters mounted between corresponding terminals on at least a portion of the lines in the connectors.

BACKGROUND OF THE INVENTION

It is common practice to use adapters comprising standard male and female electrical connectors joined in a back to back configuration for a number of purposes. For example, these adapters are commonly employed to connect daisy chained instruments to a IEEE 488 General Purpose Interface Bus (GPIB). U.S. Pat. No. 4,398,780 discloses a back to back connector configuration used in a GPIB configuration.

Filter components and circuits have also been used in back to back connector configurations. Representative disclosures of filtered adaptor connector assemblies are shown in U.S. Pat. No. 4,215,326; U.S. Pat. No. 4,126,840 and U S. Pat. No. 5,269,704. These adapters employ discrete or monolithic capacitors positioned between oppositely facing electrical connectors. A ground plate or ground member is usually disposed between the two connectors. U.S. Pat. No. 4,126,840 is an example of a device in which standard fifty position plug and receptacle connectors provide the mating connector interfaces for the adaptor. The capacitors in each of these devices are soldered to the connector terminals.

Other examples of electrical connectors in which capacitive elements are soldered to terminal pins in printed circuit boards are shown in U.S. Pat. No. 4,660,907 and in U.S. Pat. No. 4,726,790. The EMI filter connector block disclosed in U.S. Pat. No. 4,660,907 uses commercially available chip capacitors which have a substantially rectangular forme with electrical terminals disposed along opposing edges. Commercially available surface mount capacitors appear to fit this description.

U.S. Pat. No. 5,141,455 discloses an electrical connector in which discrete capacitors are attached to pins in the electrical connector by conductive adhesive. The use of soldering or conductive adhesives typically results in a relatively complicated and therefore relatively expensive assembly.

There are prior art examples in which filter components, such as discrete capacitors have been mounted in electrical connectors without the use of solder, conductive adhesives or some other bonding agent. U.S. Pat. No. 4,930,200 discloses an electrical filter connector configuration in which individual terminal pins in the electrical connector include compliant pin sections for engaging metallized opening in a printed circuit board to which surface mount filter capacitors are soldered. Ground springs are also clipped onto the printed circuit board.

U.S. Pat. No. 5,152,699 discloses a filter connector in which a support plate and the connector housing hold multilayer ceramic capacitors between pins in the connector and resilient portions of a ground plate.

U.S. Pat. No. 5,352,995 discloses an electrical connector jack containing a low-pass or band pass filter which are engaged by the jack contact springs only when a plug is inserted into the jack.

U.S. Pat. No. 5,344,342 discloses an electrical connector in which capacitors are biased against signal terminals by fingers of a grounding spring.

SUMMARY OF THE INVENTION

The subject matter of this invention is applicable both to a filtered electrical connector and to a filtered electrical connector adaptor which can be positioned between mating connectors in a multiconductor cable or a multiconductor circuit. Each electrical connector comprising a part of this filtered assembly has a plurality of terminals located side by side in an insulative housing. Each terminal has a resilient portion or plate at one end of the terminal. This resilient portion is located on the end of the terminal opposite from the connector mating portion of the terminal. An electrically conductive plate, which comprises a ground bus in the preferred embodiment of the invention, is located on one end of the connector and is spaced from the resilient portions of the terminals. A filter element, such as a standard surface mount capacitor is positioned between the resilient portion and the plate and the resilient portion urges the capacitor against the plate so that a solderless connection is maintained between the terminal and the capacitors and between the capacitor and the plate.

Although this invention can be employed with a single connector, the preferred embodiment is in the form of an adapter in which two connectors are positioned back to back with corresponding terminals in alignment. A ground plate is positioned between the two connectors and capacitors are positioned between one terminal of each aligned pair and the ground plate.

The preferred embodiment of this invention utilizes a connector having an insulation displacement wire termination portion on each terminal. Each terminal has at least one slot in which a wire inserted laterally of its axis into the slot will be engaged by the slot edges to form an electrical connection. The two terminals in each aligned pair can be connected by a wire segment inserted into the terminal slots. This wire segment extends across the top of the corresponding capacitor to help hold the capacitor in place. In the preferred embodiment of this invention the resilient portion of each terminal includes a slot and is part of the wire termination section of the terminal. When a wire segment is inserted into the slot in this resilient portion, the shape of the resilient portion is changed so that the beam length of the resilient portion engaging the capacitor is shortened to increase the force tending to maintain the electrical contact between the terminal and capacitor and between the capacitor and the ground plate or bus.

By using a connector or connector adaptor of this type a relatively simple and cost effective filtered connector or adaptor can be assembled. This assembly does not require any solder operations or any special components. Assembly also does not require any special techniques, and a reliable component can be easily and relatively inexpensively manufactured. This approach can use conventional parts including the connector and standard capacitor packages. Conventional cover plates can also be used to establish a ground path between the ground bus used in this invention and a grounded panel or chassis in which this adaptor is mounted. Although a new ground bus or ground plate is required, this plate is a simple stamped and formed part. Relaxation of or damage to the electrical contact with the capacitor over the life of the product is unlikely. The same basic concept can also be used in a filtered connector which is part of a multiconductor cable connection.

These and other objects of this invention are achieved by the representative examples of this invention which will now be described in detail.

BRIEF DESCRIPTION OF THE DRAWINGS

FIG. 3 is an exploded perspective view showing the two electrical connectors with wires extending between corresponding terminals and showing cover members exploded from the top and bottom of the connector assembly.

FIG. 4 is a perspective view of the electrical connector filter adaptor with the covers assembled to the back to back electrical connectors.

FIG. 6 shows the initial configuration of the terminals and the ground plate prior to insertion of the surface mount filter component.

FIG. 7 shows the manner in which the filter component is inserted between on terminal and the ground plate.

FIG. 8 shows the deflection of the terminal engaging the filter component prior to insertion of the wire.

FIG. 9 shows the wire as it enters slots in the two corresponding terminals prior to complete entry of the wire into the slot FIG. 10 shows the wire fully inserted into the aligned wire slots and shows the manner in which the resilient terminal deflects after complete insertion of the wire.

DETAILED DESCRIPTION OF THE PREFERRED EMBODIMENTS

Figure 1:
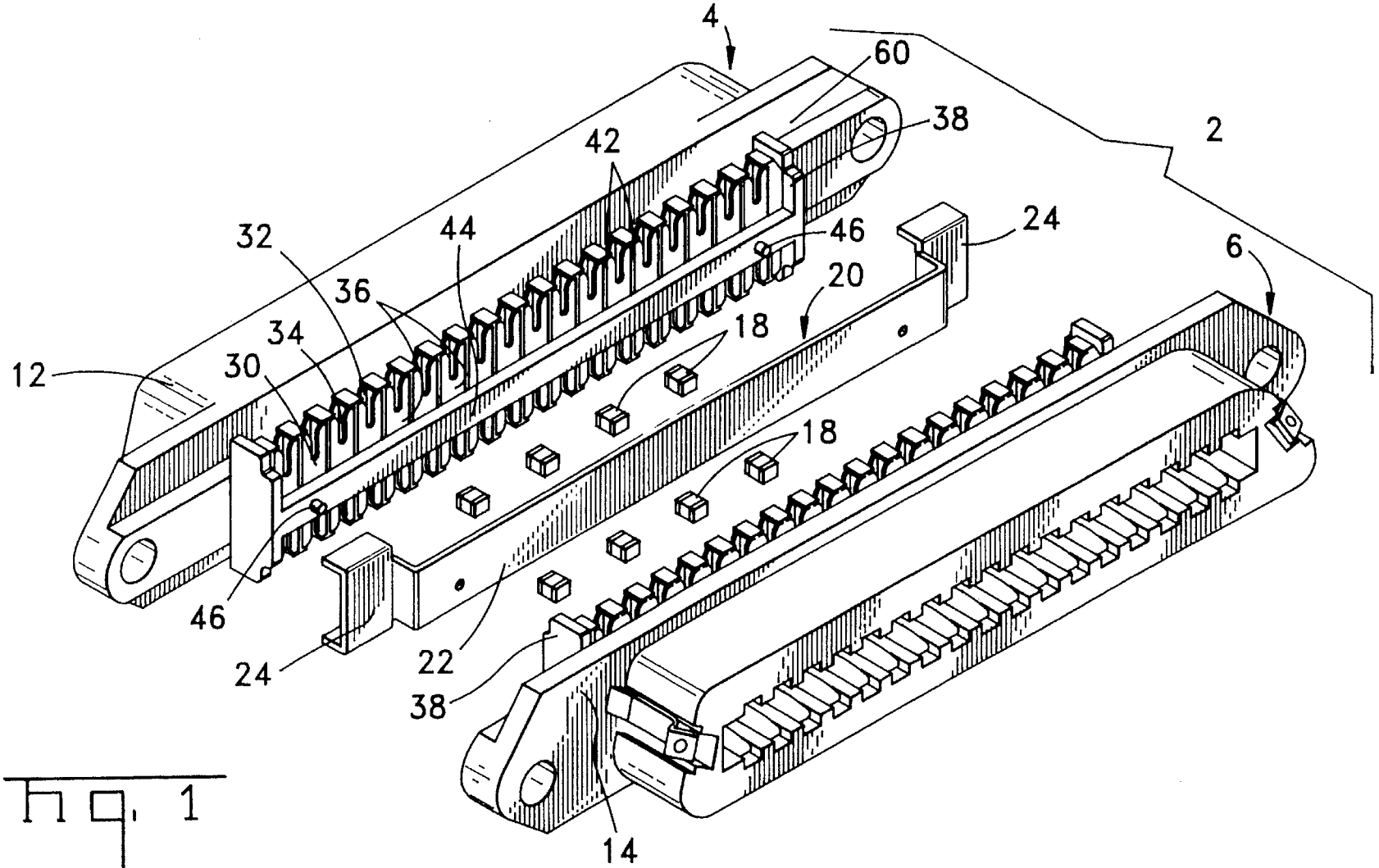
FIG. 1 is an exploded perspective view of the filtered connector assembly showing two back to back electrical connectors with a ground plate to be positioned between the two electrical connectors and a plurality of surface mount filter components to be positioned between the ground plate and terminals in each electrical connector.

Although the invention disclosed herein can be employed with a number of electrical connector configurations, it is especially adapted for use with the electrical connector disclosed in U.S. Pat. No. 3,760,335 and commercial versions of that connector manufactured and sold subsequent to issuance of that patent. U.S. Pat. No. 3,760,335 is incorporated herein by reference. The differences between the commercial versions of that connector and the embodiment shown in this patent are not significant to the invention disclosed and claimed herein.

FIGS. 1–10 depict the preferred embodiment of this filtered electrical connector adapter 2, which employs a plug or male connector 4 and a receptacle or female connector 6. These plug and receptacle connectors are mating connectors of conventional construction. These connectors are normally used to terminate twisted pair 24 or 26 AWG wires, and they meet the requirements of FCC Part 68 RJ21. Each of these connectors is an insulation displacement connector which is typically used to connect multiconductor cables. These connectors are positioned back to back in this adapter with the wire terminating sections of these two connectors adjacent to each other. Each connector has a mating end and in this adapter the mating ends of the individual connectors both face outward in position to be mated with a complementary connector.

Each connector includes a terminals 8 and 10 located in two rows. Standard connectors of this type normally employ from fourteen to sixty-four terminals spaced apart on centerlines of 0.085 inches. Each terminal in a standard connector has a mating end and an insulation displacement termination section 26. The mating ends of the male and female terminals 8 and 10 engage with complementary terminals when complementary male and female connectors are mated to the adapter.

The insulation displacement termination sections 26 of both male and female terminals are substantially identical. Each insulation displacement termination section includes an inner plate 28 and an outer plate 30 joined by two straps at the top of the two plates. See FIGS. 6–10. The inner plate 28 has an inner slot 32 and the outer plate has an outer slot 34. See FIG. 1 Both slots 32 and 34 extend into the corresponding plate from the top and the straps joining the plates are separated to provide clearance for a wire inserted into the two aligned slots 32 and 34. The slot widths are dimensioned so that the edges of each slot penetrate the insulation surrounding a wire inserted into the slot and engage the underlying conductive core. The two slots provide redundancy and the outer slot can serve as a strain relief so that the contact with between the wire and the inner slot edges is not affected by strains applied to the wire.

The outer plate 30 is located on the distal end of each terminal 8, 10. The outer slot 34 extends only partially into the plate leaving a bridging continuous plate section between the root of the slot 34 and the end of the terminal 8, 10. Each terminal is stamped and formed from a resilient material such as beryllium copper, and it is the portion of the plate below the root of each slot that is stressed to maintain the resilient contact between the wire and the terminal.

Although this invention is described as used with one embodiment of standard electrical connector terminals, it should be understood that other configurations could use this same invention. For example, a flat plate could be added on the end a terminal which uses surfaces on opposed walls of a channel shaped insulation displacement terminal to establish a resilient contact with a filter component as subsequently described. A terminal which employs another means of establishing electrical contact with a wire could also be used. For example, a connector including solder terminals could be adapted to use this invention.

The terminals 8 and 10 are mounted in male and female connector housings 12 and 14. Each connector housing has a series of side by side terminal cavities 40 extending between the mating end and the insulation displacement section 38 of the respective housings 12, 14. See FIG. 5. A central wall 44 extends between opposite ends of the connector housing and forms the inner wall of the terminal cavities 40 on opposite sides of the central wall 44. The insulation displacement housing section 38 of each housing includes cavity side walls 42 extending outward from the central wall 44 to separate adjacent cavities. A slot 60 extends transverse of the terminals 8, 10 and between the main housing section in which the connector mating interface is located and the cavity side walls 42. This slot provides clearance for a wire cutting blade used to trim wires inserted into the slots 32, 34 of the terminals 8, 10.

As can be seen in FIGS. 1–5, these conventional plug and receptacle connectors 4, 6 form two of the main components of the filtered connector adapter 2 shown in FIGS. 1–10. Four other elements form the other main components of this adaptor. FIG. 1 is an exploded view of most of the main components of this adaptor prior to assembly of the adapter 2. In addition to the plug and receptacle connectors 4, 6, FIG. 1 shows a plurality of filter components 18 and a ground bus 20. The filter components employed in the preferred embodiment comprise conventional surface mount capacitors 18. The preferred capacitors used with this invention are EIA standard 1206 ceramic capacitors which have a length of 0.123 in. (3.2 mm), a width of 0.063 in. (1.6 mm.) and height of 0.060 in. (1.5 mm.). Each end of the capacitors has a metallized section or solder coated section that is normally used to establish an electrical connection with a surface mount pad on a printed circuit board. However, these capacitors are not used in this conventional manner in this invention.

Another basic component of this adapter 2 shown in FIG. 1 is the ground bus 20 which is located between the two connectors 4, 6. This ground bus is a stamped and formed member made of an electrically conductive metal. The ground bus 20 has a center section 22 and channel shaped mounting ears 24 on each end. The ground bus is positioned between the central walls 44 of the two opposed connectors. As shown in FIG. 1, the end of central wall 44 of the plug connector 4 extends beyond the outer plate 30 of terminals 4. The central wall 44 of the receptacle connector 6 also extends outward beyond the outer plates 30 of terminals 6 as can be seen by inspection of FIG. 5. The width of the central section 22 of ground bus 20 is greater than the width of the central walls 44 of the two opposed connectors so that the ground bus protrudes upward beyond the central walls when assembled between the connectors 4, 6. The mounting ears 24 engage ribs on the insulative housing of the plug connector housing 12 on the ends of the rows of terminals 8. Dowel pins 46 extending from the end of the central wall 44 extend through holes in the central section to position the ground bus 20. Only one ground bus 20 is positioned between the opposed connectors 4, 6, and capacitors are positioned between terminals 8, 10 in opposed connectors and the single ground bus 20.

Figure 2:
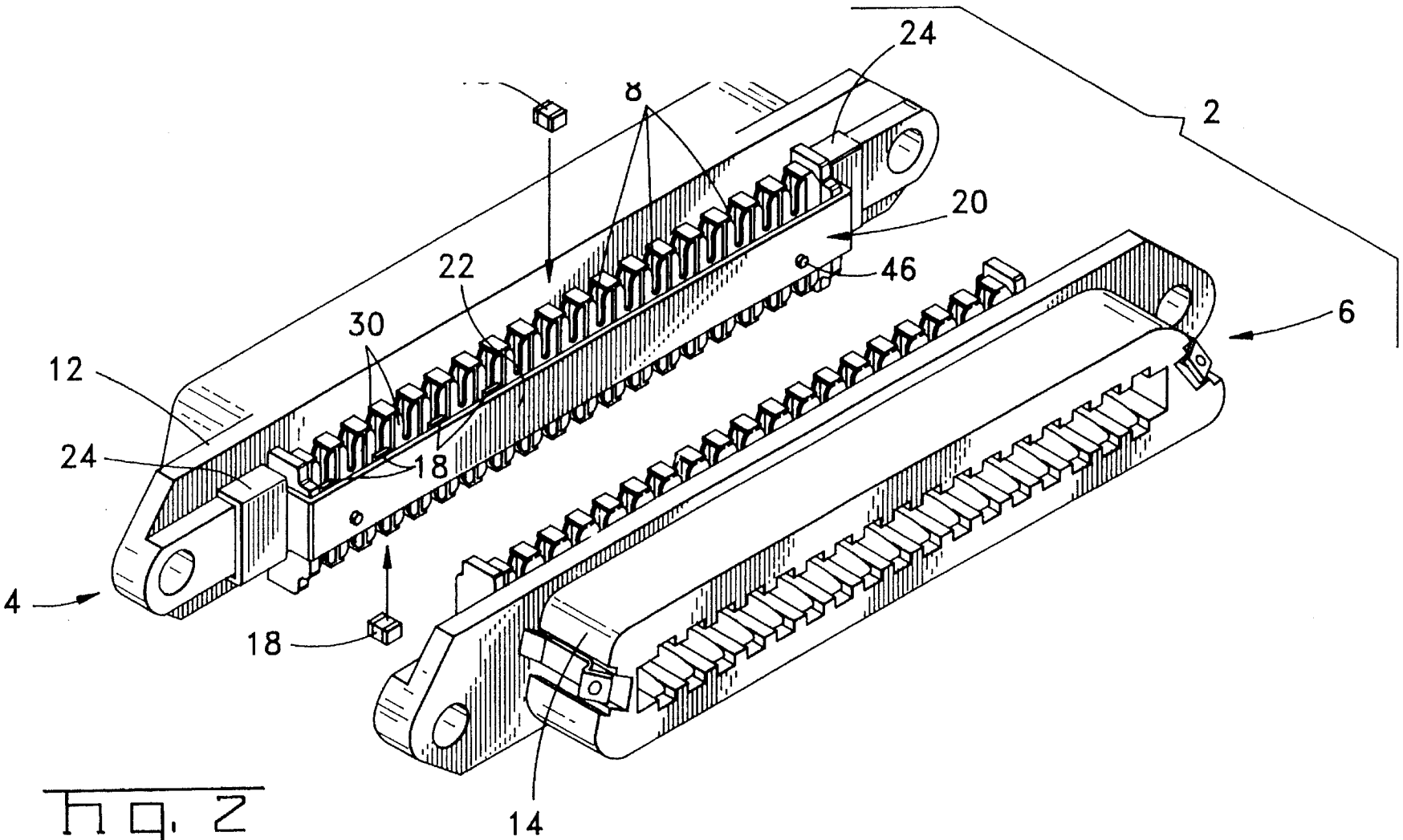
FIG. 2 is an exploded perspective view similar to FIG. 1 showing the ground plate positioned on one of the electrical connectors with a portion of the surface mount filter components inserted between the ground plate and corresponding terminals in the one electrical connector.

FIG. 2 shows the initial steps in the assembly of the assembly of the filter connector adapter. The ground bus 20 is positioned on the plug connector 4. Some capacitors 18 are shown positioned between the outer plates 30 of terminal 8 in the two rows of the connector 4. Capacitors are only located between every other terminal 8 and the ground bus in this embodiment. Capacitors may also be located between every terminal 8 and the ground bus if desired. The next step is the assembly of the receptacle or female connector 6 to the subassembly of the male or plug connector 4 and the ground bus 20. This can be done using conventional screws through the bosses on the ends of each connector, or the two back to back connectors can be positioned in a temporary assembly fixture. This is a conventional method of connecting back to back connectors of this type, and therefore the screws are not illustrated. Capacitors 18 can then be positioned between the outer plates 30 of the terminals 10 in the female connector 6 and the ground bus 20. See FIG. 5. Again capacitors are only placed between alternate terminals and the ground bus, and the capacitors 18, positioned in the female connector, engage terminals in the intervening positions where capacitors are not located in the male connector half of this subassembly. Only one capacitor is needed for each line and terminals in the same positions will be connected in the next step in the assembly of this adapter 2.

FIG. 3 shows this next step in the assembly of adapter 2. Short sections of insulated wire 58 are inserted into the aligned slots 32, 34 in the aligned opposed male and female terminals 8, 10 in the two back to back connectors 4, 6. In the preferred embodiment these wire sections comprise pvc insulated, solid conductor wires. Other conductors, such as wires in a ribbon-like cable, or the like, may also be used. With the wires in place, aligned terminals in the same position are interconnected and the single capacitor 18 between one terminal to the ground bus 20 is electrically between its complementary terminal in the adapter 2 and ground. These wires are inserted into the aligned slots 32, 34 of each terminal by using a conventional insertion technique. An inserter moves toward the terminals and pushes the wires into the slots. The wire sections 58 not only serve to hold the chips firmly in place, but when all of the wires are inserted into the insulation displacement slots of both connectors, the wire segments 58 hold the plug and receptacle assemblies together.

After the wires are fully inserted, hermaphroditic ground cover plates 16 are attached to the opposed connector subassembly. Each of these cover plates 16 can be a cast zinc plate or a metallic coated plastic cover plate. Each cover plate 16 has a rib 48 on its interior surface. When the cover plates are mated to the connector subassembly, these ribs 48 engage the mounting ear 24 of the ground bus 20 to establish a ground path. FIG. 4 shows the completed adapter assembly with the cover plates 16 mated with the opposed connectors 4, 6. Screws 54 inserted though holes 50 in one cover plate engage threaded holes 52 in the other to secure the two cover plates in place. The adapter 2 as shown in FIG. 4 can be inserted in the opening of a metallic panel, such as an opening in the chassis of a device cover, and a ground connection is thus established through the cover plates 16.

Figure 5:
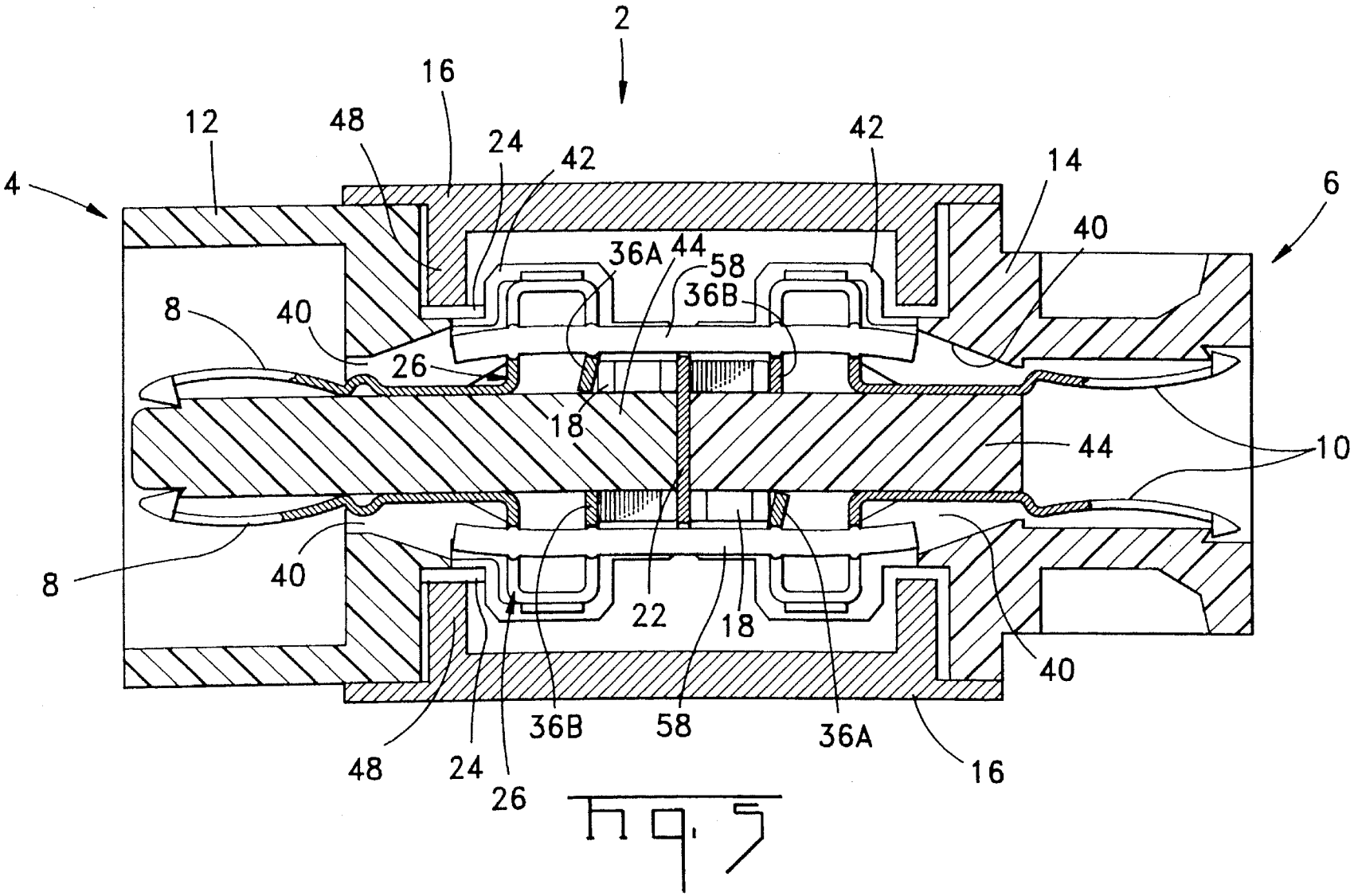
FIG. 5 is a side sectional view of the two back to back electrical connectors showing the position of the filter components, the wires connecting corresponding terminals and showing the deflection of the portion of the terminals engaging the surface mount filter components.

The side sectional view shown in FIG. 5 shows the basic elements of the adapter assembly 2. FIG. 5 also shows four terminals in two rows in the same plane. Since capacitors 18 are located in alternate positions, only two capacitors are shown in this view. The terminal plates 28 and 30 are sectioned through the slots 32 and 34. Note that the lower sections 36A of the terminal plates 30 engaging the capacitors 18 are bent while the sections 36B which do not engage the capacitors remain straight as in a terminal used in a conventional manner.

Figure 6:
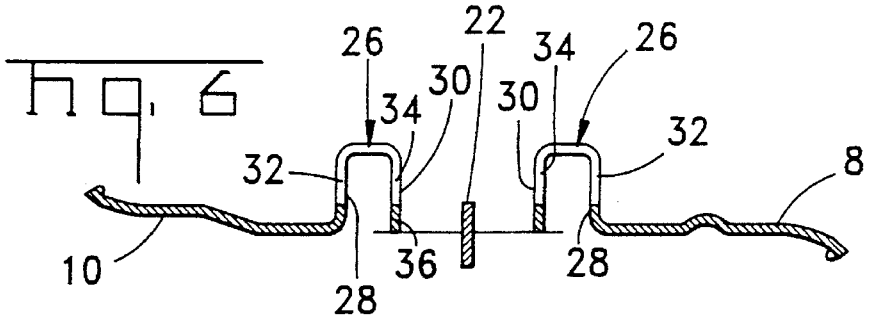
FIGS. 6–10 is a series of diagrammatic views showing corresponding back to back terminals, and showing the insertion of a surface mount filter component between the intermediate ground plane and the terminal.
Figure 7:
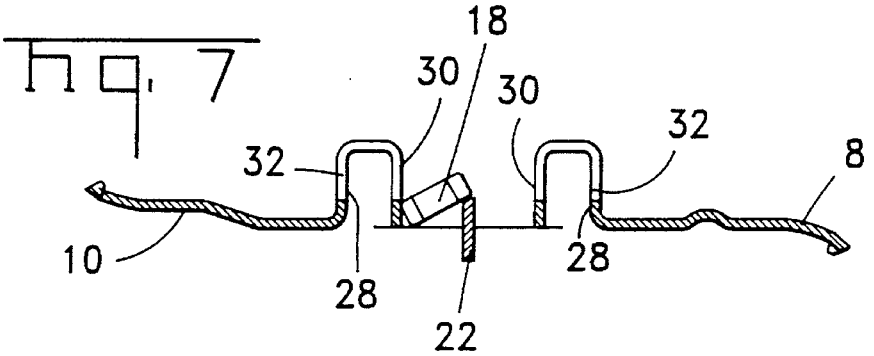
Figure 8:
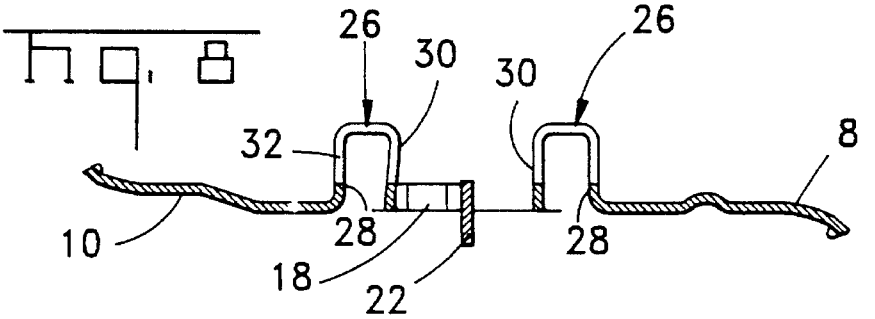
Figure 9:
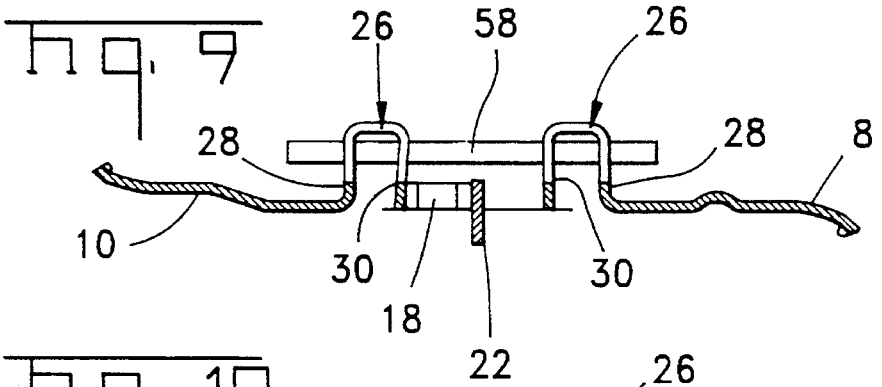
Figure 10:
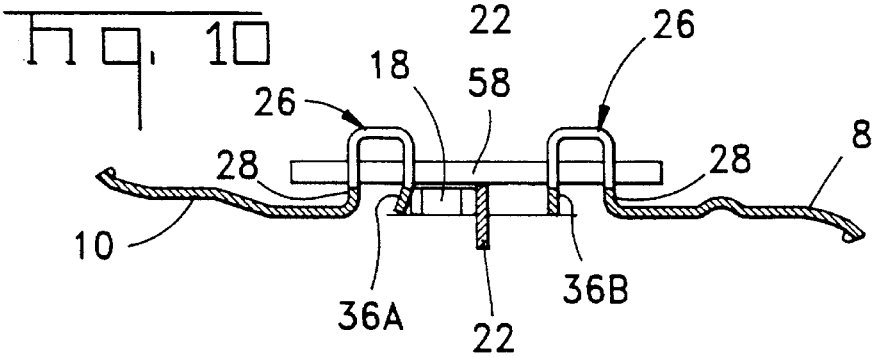

FIGS. 6–10 are diagrammatic views showing the action of the terminals 8 and 10 when a capacitor 18 is inserted between an outer terminal plate 30 and the central section 22 of a ground bus 20. These diagrammatic views show only the two opposed terminals and the ground bus. In these diagrammatic views, the terminals are sectioned through the same plane as shown in FIG. 5 so that the slots 32 and 34 can be identified in these views. The insulative housing has been omitted. FIG. 6 shows the terminals and the ground bus prior to insertion of the capacitor 18. FIG. 7 shows the initial placement of a capacitor 18 between one terminal and the ground plate 22. The length of the capacitor 18 is greater than the space between the outer plate 30 and the ground bus central section 22 between the two opposed terminals. When the capacitor 18 is forced into place as shown in FIG. 8, the outer plate flexes about the intersection between the outer plate 30 and the straps joining the two plates 28, 30. FIG. 9 shows a wire section 58 positioned in the entry portion of the slot in the plates 28, 30 of each terminal. The wire section 58 has not been inserted into the slots at this point, and the outer plate 30, engaging the capacitor 18, still flexes about the straps at the top of the plate. In FIG. 10, the wire section 58 has been fully inserted into the slots in the inner plate 28 and the outer plate 30 of each terminal. Full insertion of the wire into the slot of the outer plate 30, engaging the capacitor, causes the portion of the plate 30 adjacent to the slot to straighten, and the portion of the plate 36a below the wire is bent inwardly and engages the upper edge of the metallized portion of the capacitor 18. The length of the resilient beam is therefore shortened. The resilient force exerted by the outer plate 30 therefore increases and is sufficient to establish a reliable connection between the ends of the capacitor and the terminal plate 30 and the ground plate central section 22. The wire segments 58 also serve to hold the capacitors 18 in place because the wires are positioned on top of the capacitors.

Figure 11:
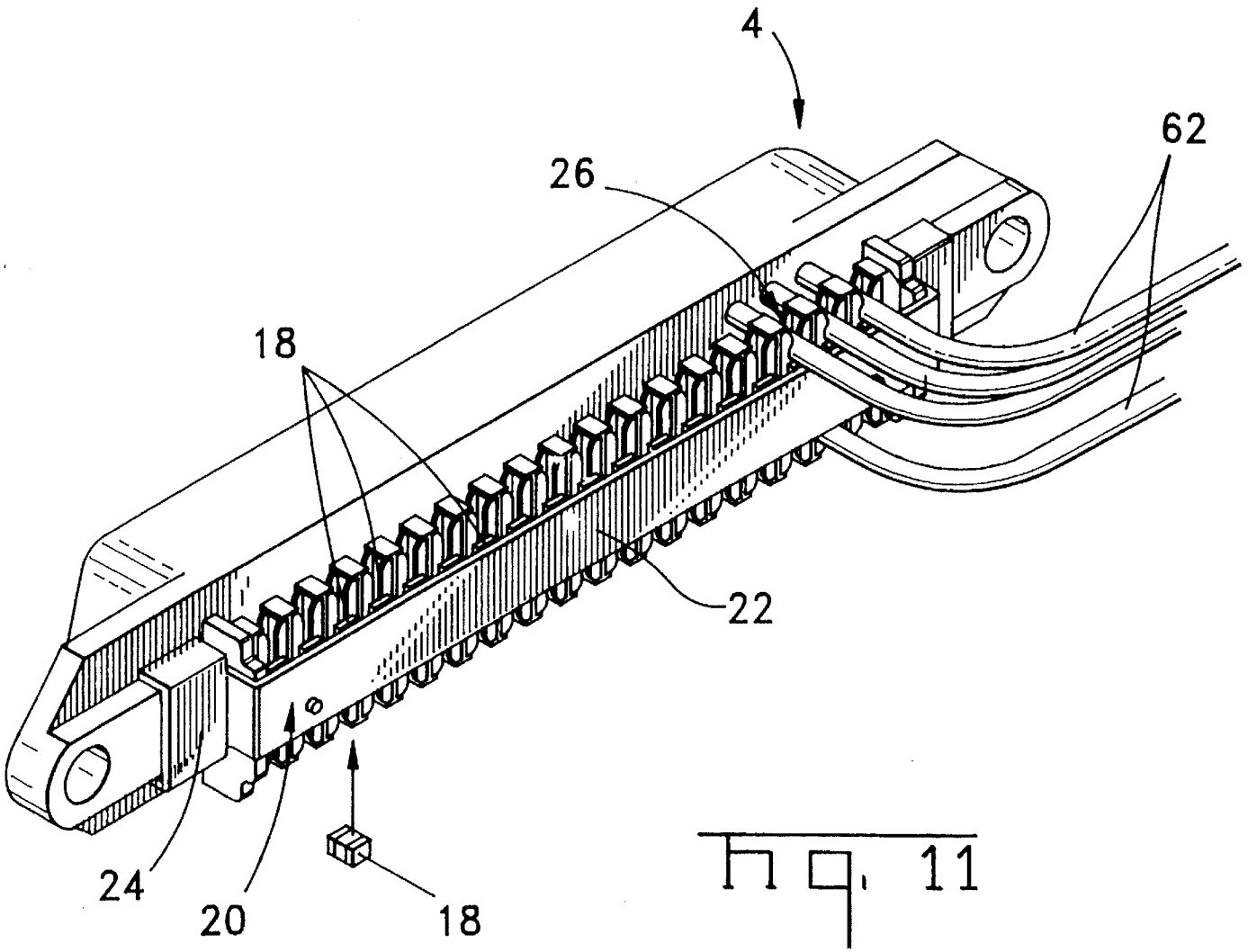
FIG. 11 is an alternate view of the invention showing a single connector with filter components between the terminals and the ground plate, in which the wires attached to the terminals are wires in a cable to which the connector is attached.

FIG. 11 shows the manner in which this invention can be adapted to a single connector 4 instead of a two connector adapter assembly. In this embodiment, capacitors would be placed between the outer plate of each terminal and the ground bus 20. The same ground bus 2 and capacitors would be used with this configuration. Instead of using a separate wire segment, the normal termination of cable wires in the two slots of each terminal will function in the same way as the wire segments in the principal embodiment.

As previously described, this invention is especially useful with connectors of the types disclosed herein. It should be understood that the invention is applicable to other configurations. Other terminals can be adapted for use in this assembly and insulation displacement terminals of this type can be used in other connectors to make it easier to adopt this invention.

This invention can also be extended to other applications not shown in the representative embodiments discussed in this application. For example, the ground bus 22 comprises an electrically conductive plate or substrate and could be replaced by a printed circuit board. Capacitors or other components could then be positioned between the terminals and pads on the surface of the printed circuit board. The traces on the printed circuit boards could then be connected to other circuitry for filtering or other signal conditioning.

Although this invention employs separate terminals in each connector, this invention could employ an assembly in which a single terminal extends into both connector housings. For example a terminal having a single insulation displacement section but with opposed male and female mating sections could be inserted into two opposed housings. This would eliminate the need for the wire segments and is compatible with the broader aspects of this invention. Cable wires could be used in the manner described with reference to the embodiment of FIG. 11. Of course this modification would also require modification of the ground bus. A clearance slot could be added to the central section of the ground bus to permit the terminals to pass through the ground bus without shorting. Alternatively, continuous terminals having upright resilient plates, but no insulation displacement sections, could also be used.

Modifications can also be made to individual elements of this invention. For example, the electrically conductive cover plates do not represent the only means for connecting the ground plate to ground. If one or more of the cable conductors is connected to ground, a zero value surface mount resistor can be positioned between the corresponding terminal and the ground plate to establish a ground path. These are only examples of alternate versions of connectors and connector adapters which can employ the invention as claimed herein.

I claim:

1. A filtered electrical connector comprising a plurality of electrical terminals mounted in an insulative housing, the terminals having a resilient portion on one end thereof, an electrically conductive plate spaced from the resilient portions of the terminals, and a surface mount chip component positioned between the resilient portion of at least one said terminal and the electrically conductive plate, with metallized portions of the surface mount chip component being in electrical contact with the corresponding terminal and the electrically conductive plate, the terminals including a wire contact section, and wherein a wire is secured to each terminal, the wire being positioned on top of the corresponding surface mount chip component, the wire holding the surface mount chip component between the resilient portion and the electrically conductive plate.

2. The filtered electrical connector of claim 1 wherein the electrically conductive plate comprises a ground plate.

3. The filtered electrical connector of claim 2 wherein the resilient portion is part of the wire contact section and the wire is attached to the resilient portion of each terminal.

4. The filtered electrical connector of claim 3 wherein the resilient portion of each terminal comprises a plate having a slot therein, the wire being positioned in the slot so that edges of the slot establish electrical contact with the wire.

5. The filtered electrical connector of claim 4 wherein the root of each slot is spaced from the edge of the plate, the portion of the plate between the root of slot and the plate edge being bent upon insertion of the wire into the slot so that the bent portion of the plate partially overlaps the surface mount chip component.

6. The filtered electrical connector of claim 4 wherein insertion of the wire into the slot reduces the beam length of the resilient plate section engaging the surface mount chip component.

7. The filtered electrical connector of claim 2 wherein the ground plate is secured to the insulative housing, the connector further including a ground cover attached to the insulative housing and including a surface engaging the ground plate.

8. The filtered electrical connector of claim 7 wherein the surface engaging the ground plate comprises a rib on the interior of the cover.

9. The filtered electrical connector of claim 8 wherein the ground plate includes mounting ears engaging the insulative housing, the rib on the cover engaging the mounting ears when assembled to the connector.

10. A filtered electrical connector adaptor comprising two electrical connectors positioned back to back with outwardly facing mating ends; an electrically conductive substrate positioned between the back to back electrical connectors, each electrical connector having a plurality of terminals, each terminal having at least one resilient section; and a filter component positioned between at least a portion of the terminals and the electrically conductive substrate, the filter component being positioned between the terminal resilient section and the electrically conductive substrate with electrically conductive portions of the filter component engaging the resilient portion of the corresponding terminal and the electrically conductive substrate.

11. A filtered electrical connector adaptor comprising two electrical connectors positioned back to back with outwardly facing mating ends, each connector having a wire contact portion adjacent the other connector, a ground plate secured between the back to back electrical connectors adjacent the wire contact portions of each electrical connector, each electrical connector having a plurality of terminals, each terminal having a resilient section in the wire contact portion of each electrical connector, and a filter component positioned between at least a portion of the terminals and the ground plate, the filter component being positioned between the terminal resilient section and the ground plate with electrically conductive portions of the filter component engaging the resilient portion of the corresponding terminal and the ground plate.

12. The filtered electrical connector adaptor of claim 11 wherein one filter component engages one of two corresponding terminals in the two electrical connectors, the two corresponding terminals being separately electrically connected.

13. The filtered electrical connector adaptor of claim 12 wherein the two corresponding terminals are separately electrically connected by a wire engaging wire contact sections of the two corresponding terminals.

14. The filtered electrical connector adaptor of claim 13 wherein each wire overlaps the corresponding filter component.

15. The filtered electrical connector adaptor of claim 14 wherein the resilient section of each terminal comprises a terminal plate having a slot extending into the plate form one edge thereof, the wires being positioned in the slots of corresponding terminal plates.

16. The filtered electrical connector adaptor of claim 15 wherein each terminal has two side by side terminal plates, each with a slot therein, the wire being positioned in both slots, one of the plates being independent of the resilient plate engaging the filter component so that the connection of each wire to the two corresponding terminals is independent of deflection of the resilient plates.

17. The filtered electrical connector adaptor of claim 16 wherein the two terminal plates are joined by strap sections adjacent the ends of the plates into which the slots extend, the resilient plate initially deflecting about the juncture of the straps and the resilient plate prior to insertion of the wire into the slots, insertion of the wire into the slots causing the resilient plate to flex about a point adjacent to the wire in the resilient plate slot so that the force exerted by the resilient section against the filter component is increased by insertion of the wire into the slots.

18. The filtered electrical connector adaptor of claim 11 wherein the filter component comprises a surface mount chip component.

19. The filtered electrical connector adaptor of claim 18 wherein the surface mount chip component comprises a surface mount capacitor.

20. The filtered electrical connector adaptor of claim 11 wherein an electrically conductive cover is mounted between the two electrical connectors, the cover engaging the ground plate to establish a ground path with the ground plate.

* * * * *

UNITED STATES PATENT AND TRADEMARK OFFICE

CERTIFICATE OF CORRECTION

PATENT NO. : 5,562,499
DATED : October 8, 1996
INVENTOR(S) : Steven E. Minich

It is certified that error appears in the above-identified patent and that said Letters Patent is hereby corrected as shown below:

On the title page, item [73] is corrected to state:

--Assignee: The Whitaker Corporation, Wilmington, DE--

Signed and Sealed this

First Day of April, 1997

*Attest:*

*Attesting Officer*

BRUCE LEHMAN

*Commissioner of Patents and Trademarks*